US007434345B2

(12) United States Patent
Verdugo

(10) Patent No.: US 7,434,345 B2
(45) Date of Patent: Oct. 14, 2008

(54) RETICULE

(76) Inventor: Edward A. Verdugo, P.O. Box 1246, Beaumont, CA (US) 92399

( * ) Notice: Subject to any disclaimer, the term of this patent is extended or adjusted under 35 U.S.C. 154(b) by 212 days.

(21) Appl. No.: 11/470,242

(22) Filed: Sep. 5, 2006

(65) Prior Publication Data

US 2007/0022651 A1 Feb. 1, 2007

Related U.S. Application Data

(63) Continuation-in-part of application No. 10/708,288, filed on Feb. 23, 2004, now Pat. No. 7,100,320.

(51) Int. Cl.
*F41G 1/10* (2006.01)
*F41G 1/12* (2006.01)

(52) U.S. Cl. ..... 42/130; 42/122; 42/133; 42/144

(58) Field of Classification Search ..... 42/113, 42/122, 123, 130, 131, 133, 144, 145
See application file for complete search history.

(56) References Cited

U.S. PATENT DOCUMENTS

| | | | | |
|---|---|---|---|---|
| 0,189,721 | A | | 4/1877 | Freund |
| 0,912,050 | A | | 2/1909 | Wanee |
| 1,088,137 | A | | 2/1914 | Fidjeland |
| 1,190,121 | A | | 7/1916 | Crichett |
| 2,420,273 | A | | 5/1947 | West |
| 3,190,003 | A | | 6/1965 | O'Brien |
| 3,392,450 | A | | 7/1968 | Herter et al. |
| 3,588,255 | A | * | 6/1971 | Alexander ..... 356/152.1 |
| 3,782,822 | A | | 1/1974 | Spence |
| 3,948,587 | A | | 4/1976 | Rubbert |
| 4,070,763 | A | * | 1/1978 | Carts, Jr. ..... 42/132 |
| 4,263,719 | A | | 4/1981 | Murdoch |
| 4,618,221 | A | | 10/1986 | Thomas |
| 4,850,113 | A | * | 7/1989 | Doll ..... 42/130 |
| D306,173 | S | * | 2/1990 | Reese ..... D16/130 |
| 4,957,357 | A | | 9/1990 | Barnes et al. |
| 6,058,921 | A | | 5/2000 | Lawrence et al. |
| 6,445,497 | B1 | | 9/2002 | Adda |
| 6,591,537 | B2 | | 7/2003 | Smith |
| 6,681,512 | B2 | | 1/2004 | Sammut |

* cited by examiner

*Primary Examiner*—Stephen M Johnson
(74) *Attorney, Agent, or Firm*—Geoffrey E. Dobbin

(57) ABSTRACT

The present invention is a reticule featuring both rapid close-quarters target acquisition and precise distance shooting functionality. The reticule features a broad central aiming ring and four sets of aiming point-indicating dots. The lowest set comprises dots of differing dimensions and distances apart. Ranging rings are also provided. In an alternate embodiment the aiming ring comprises a plurality of varying transparent and opaque cells. The reticule can be illuminated through known or future discovered means for low-light or night shooting. A further alternate embodiment features a caliber specific ranging system.

20 Claims, 4 Drawing Sheets

(c) 2003 Ed Verdugo 201
202
203
210
235
3
5
10
15
220
222
224
226
207

RETICULE

CROSS-REFERENCES TO RELATED APPLICATIONS

This Application is a Continuation-in-Part of prior application Ser. No. 10/708,288, filed Feb. 23, 2004, now U.S. Pat. No. 7,100,320, issued Sep. 5, 2006 and incorporates the earlier application by reference.

COPYRIGHT NOTICE

A portion of the disclosure of this patent document contains material that is subject to copyright protection. The copyright owner has no objection to the facsimile reproduction by anyone of the patent disclosure as it appears in the Patent and Trademark Office patent files or records, but otherwise reserves all copyright rights whatsoever.

FIELD OF INVENTION

The present invention relates to the field of reticules, and more particularly relates to a reticule for a telescopic sight system while being useful in both rapid target acquisition in close quarters combat and precise distance shooting situation

BACKGROUND OF THE INVENTION

Reticules are well known in the prior art. They are used in any situation where aiming any type of device is necessary, ranging from medical devices to weapons. Reticule types range from the traditional "crosshairs" to dots, circles, other geometric shapes, and moveable cross lines or any combination of the above. For example, U.S. Pat. No. 6,681,512 (2004) to Sammut; U.S. Pat. No. 6,591,537 (2003) to Smith; U.S. Pat. No. 6,453,595 (2002) to Sammut; U.S. Pat. No. 6,357,158 (2002) to Smith, III; U.S. Pat. No. 6,058,921 (2000) to Lawrence, et al.; U.S. Pat. No. 4,957,357 (1990) to Barnes, et al.; U.S. Pat. No. 4,618,221 (1986) to Thomas; U.S. Pat. No. 4,263,719 (1981) to Murdoch; U.S. Pat. No. 3,948,587 (1976) to Rubbert; U.S. Pat. No. 3,782,822 (1974) to Spence; U.S. Pat. No. 3,392,450 (1968) to Herter, et al.; U.S. Pat. No. 2,420,273 (1944) to West; U.S. Pat. No. 1,190,121 (1916) to Critchett; U.S. Pat. No. 1,088,137 (1914) to Fidjeland; U.S. Pat. No. 912,050 (1909) to Wanee; and U.S. Pat. No. 189,721 (1877) to Freund are all illustrative of the prior art.

While the aforementioned inventions accomplish their individual objectives, they do not describe a reticule that is useful for both rapid close range target acquisition and precision shooting at a distance. In this respect, the reticule according to the present invention departs substantially from the usual designs in the prior art. In doing so, this invention provides a simple reticule using an aiming point strategy in its design and functionality. The reticule according to the present invention also incorporates a plurality of aiming points represented as dots of different scales to facilitate use at various ranges, from 10 to 600 yards or beyond. Prior reticules attempt to compensate for drop of a bullet over distance by increasing the distance between provided reticule guidelines. While one embodiment of the reticule according to this invention does so, in general, the reticule according to the present invention does not attempt to do so. In the present invention, a set of smaller scale dots provides a reference point for a shooter to use after practicing with a particular weapon over time, thereby avoiding problems of translating the results of "average" weapons to a particular weapon. Simultaneously, the reticule according to the present invention covers less of a target area, decreasing uncertainty and having a corresponding increase in hit potential.

SUMMARY OF THE INVENTION

In view of the foregoing disadvantages inherent in the known types of reticule, this invention provides an improved reticule with varying scales for use in multiple range environments. As such, the present invention's general purpose is to provide a new and improved reticule that will allow a user to improve accuracy and time at a distance without being a hindrance at close range.

To accomplish this goal and still maintain a utility derived from simplicity, the reticule according to the present invention comprises a main aiming ring with a series of aiming dots extending from the ring in what would be considered the cardinal directions. The aiming ring is utilized for speed and accuracy in close targeting scenarios, providing a broad, easily identifiable aiming point. The "southern" portion of the targeting ring is empty, allowing for a series of aiming dots to extend from the center of the ring to the bottom of the reticule. As the southern dots extend from the ring, they gradually are reduced in size and are spaced at a lesser distance apart. Thin reference rings are positioned towards the bottom of the reticule for range estimation. The reticule may be made of a luminous material, or may be electronically or chemically induced to glow for night and low light use.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the reticule is herein described. It should be noted that the articles "a", "an" and "the", as used in this specification, include plural referents unless the content clearly dictates otherwise.

Figure 1:
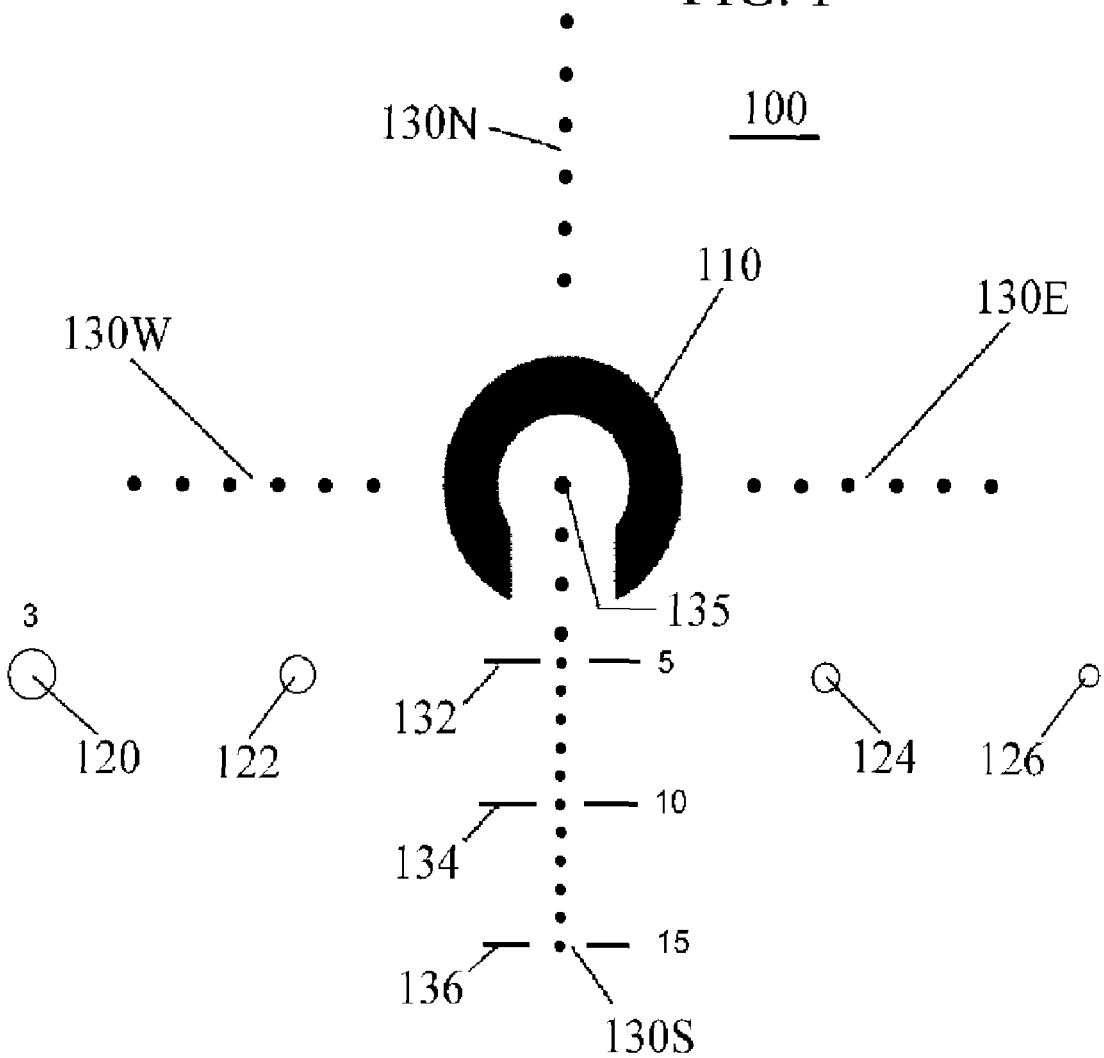
FIG. 1 is a plan view of the reticule according to the present invention.

Referring specifically to FIG. 1, reticule 100 is has a central aiming ring 110, a plurality of varying sized ranging rings 120, 122, 124, 126, and four sets of dots in linear patterns defining four cardinal directions, 130N, 130S, 130E, 130W. Throughout this application and in the claims, the term "dot" is used to define an indicator of the location of generic aiming points on the reticule. The term "dot" may be used of indicators of any shape, such as triangles, crosshairs, ovals and rectangles, and need not necessarily be circles. Aiming ring 110 is not a complete ring, as it is open towards the southern direction. Dot set 130S initiates in the center of the reticule with central aiming point 135 and is comprised of dots of three different sizes and two different spacing intervals, as shall be described later in this specification. Labeled quick count lines 132, 134, 136 may be provided at any interval, though the shown preferred embodiment is an interval of 5. Ranging ring 120 is labeled "3" on the reticule.

The utility of the reticule 100 is found in the set spacing and sizes of the individual components relative to each other. The reticule uses the same basic perspective principles used in other ranging reticules, that is that objects appear smaller the further they are away from a viewer. Aiming ring 110 has a thickness of 4 Minutes Of Angle ("MOA"). 1 MOA is roughly equivalent to 1 inch at 100 yards. Its diameter is 18 MOA, leaving a 10 MOA window interior. Each of the dots in directional sets 130N, 130E, and 130W are 0.75 MOA, and the central aiming point 135 is 1 MOA. The next highest dots in set 130S are 0.75 MOA. Each of these dots has an interval spacing of 3.5 MOA. Staring with the dot labeled "5" in the southern set 130S, the remaining dots are 0.5 MOA and have an interval spacing of 2 MOA. Ranging rings 120, 122, 124, 126 have diameters of 3.33 MOA, 2.5 MOA, 2 MOA, and 1.67 MOA respectively. To maintain proper perspective of relative sizes of the reticule components with potential targets, the reticule should be positioned either on or next to the objective lens of any telescopic sighting devices, thereby magnifying the reticule in the same power as the target and maintaining proportion. It should be noted that aiming ring 110 may be of any shape, though depicted as round in the figures. The important characteristics of aiming ring 110 is that it is relatively broad compared to the rest of the reticule and that it has an incomplete perimeter at its bottom. Any reasonable shape may, therefore be used, be it ovular, rectangular, triangular, octangular, or any other polygonal shape. The term "ring" as used in this specification and the appended claims must, therefore, include such equivalent structures.

In use, the reticule according to the present invention provides a rapidly identified aiming point in close quarters combat situations, as the reticule provides an easily identified center target with aiming ring 110. This is especially true if the sighting device is set at zero magnification, thus diminishing all other reticule components from view. The reticule also provides ranging capability for more accurate distance shooting. Aiming ring 110 and ranging rings 120, 122, 124, and 126 are set to measure the equivalent of 10-inch targets at 100, 300, 400, 500, and 600 yards distance. Central aiming point 135 is the center of aiming ring 110 and therefore defines the diameter of a 5 MOA circle with any single point within the inner rim of the aiming ring 110. This corresponds to a 10-inch target at 200 yards. While the four ranging rings are provided in the preferred embodiment, more or fewer rings may be employed in the practice of this invention. Likewise, different shapes may also be used, though in all embodiments the shapes should be mere outlines, allowing a user to see past the shape.

For distance shooting, it is important to consider the drop of a bullet over distance. The amount of drop will be determined by a number of factors, including barrel length, rifling, bullet weight, charge of ammunition, etc. Together, these factors are called a "package" and are usually uniform over time for a user's weapon. The scope can be zeroed so that the central aiming point 135 represents where a bullet will hit at 200 yards. Once this is set, a user merely practices with his or her particular weapon package to determine at which dot in the southern set 130S a bullet will hit at specified yardage. Since the lower portion of southern set 130S is used in distance shooting, the dots are smaller and the distance between them is smaller, so that less of a target is covered by a dot at greater distance from the shooter. With less of a target covered, there is greater accuracy in the shooting due to less uncertainty as to the actual spot where the bullet will hit. In the present embodiment, a 0.5 MOA dot will cover only 3 inches of a target at 600 yards. The distance between the dots in the lower range is 2 MOA, corresponding to 12 inches at 600 yards. The central aiming dot 135 would cover 6 inches at 600 yards, presenting double the uncertainty and a corresponding drop in accuracy.

Through practice, a user may note where a bullet will hit on the reticule at a determined distance. Afterwards, when a user picks a target of a known size, comparisons are made with ranging rings 120, 122, 124, and 126, as well as with the interior of aiming ring 110, to determine distance. When aiming at the target, the user merely picks the appropriate aiming point from the dots in set 130S and fires, hitting the target. The preferred embodiment attaches no external significance to the aiming points represented by the dots, unlike various other prior art reticules which attempt to compensate for the amount of drop a bullet will have over distance. The importance of the smaller dots and smaller distance between them is for better accuracy with a particular weapon. Remaining dot sets 130N, 130E, 130W are ideally set to a uniform standard, for instance the standard military dot ranging system, and are useful as guides for windage and canting calculations and for ranging in horizontal and vertical planes.

In low light situations, the reticule may be illuminated through conventional means, or means to be discovered. Ideally, ranging rings 120, 122, 124, 126, dots sets 130N, 130S, 130E, 130W, and aiming ring 110 would have illumination capability. A highlighting ring, such as 311 in FIG. 3, is used in those situations where illumination of the central aiming ring 110 is difficult or impossible.

Figure 2:
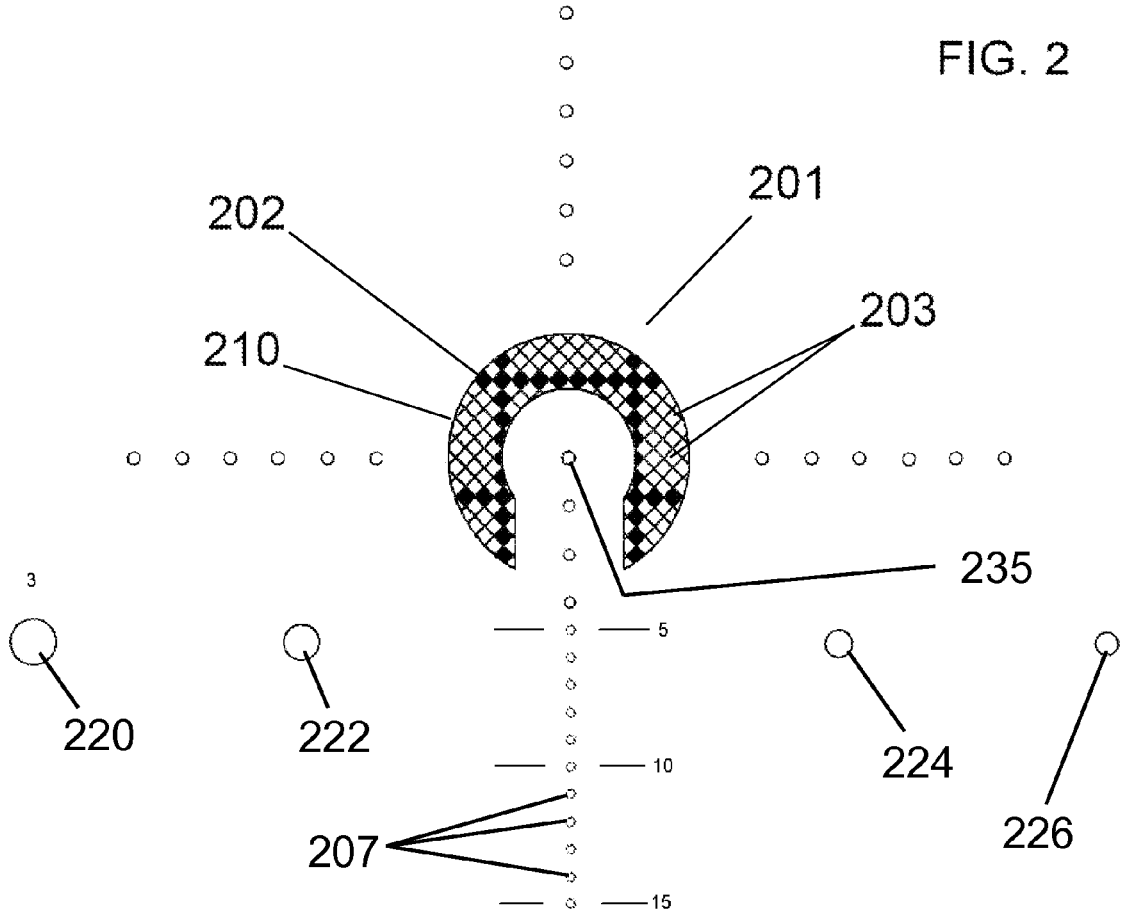
FIG. 2 is a plan view of an alternate embodiment of the reticule.

In an alternate embodiment, shown in FIG. 2, the aiming ring 210 is composed of a plurality of transparent cells 203, allowing a user to see through a portion of the aiming ring 210. Cells 203 may be of any shape, though regular polygons, such as the diamond pattern shown in FIG. 2, circles and ovals are preferred. Ideally, the lines dividing aiming ring 210 should be thinner than cells 203, allowing a user to see "through" over ½ of the area covered by the aiming ring 210. This construction of the aiming ring 210 allows a user to look through the aiming ring 210 while still having the capacity to use it. It is also easier to illuminate aiming ring 210 when using the depicted or similar cell constructions, as uniform lines are easier to illuminate using current technology. Dots 207 and 235 and rings 220, 222, 224, 226, may be of any shape, and may actually mimic the construction of cells 203.

Some of the cells may be obscured 202 in a manner to provide greater contrast and increase acquisition speed. Obscured cells may demarcate a part of aiming ring 210 (as shown) or they may outline the perimeter of aiming ring 210 or they may be spaced at a regular pattern about the aiming ring. In either event, a user should still see through at least ½ of the aiming ring for this embodiment to maintain a good portion of its utility, though a greater percentage of obscured cells and different patterns would still be considered the purview of this invention.

Figure 3:
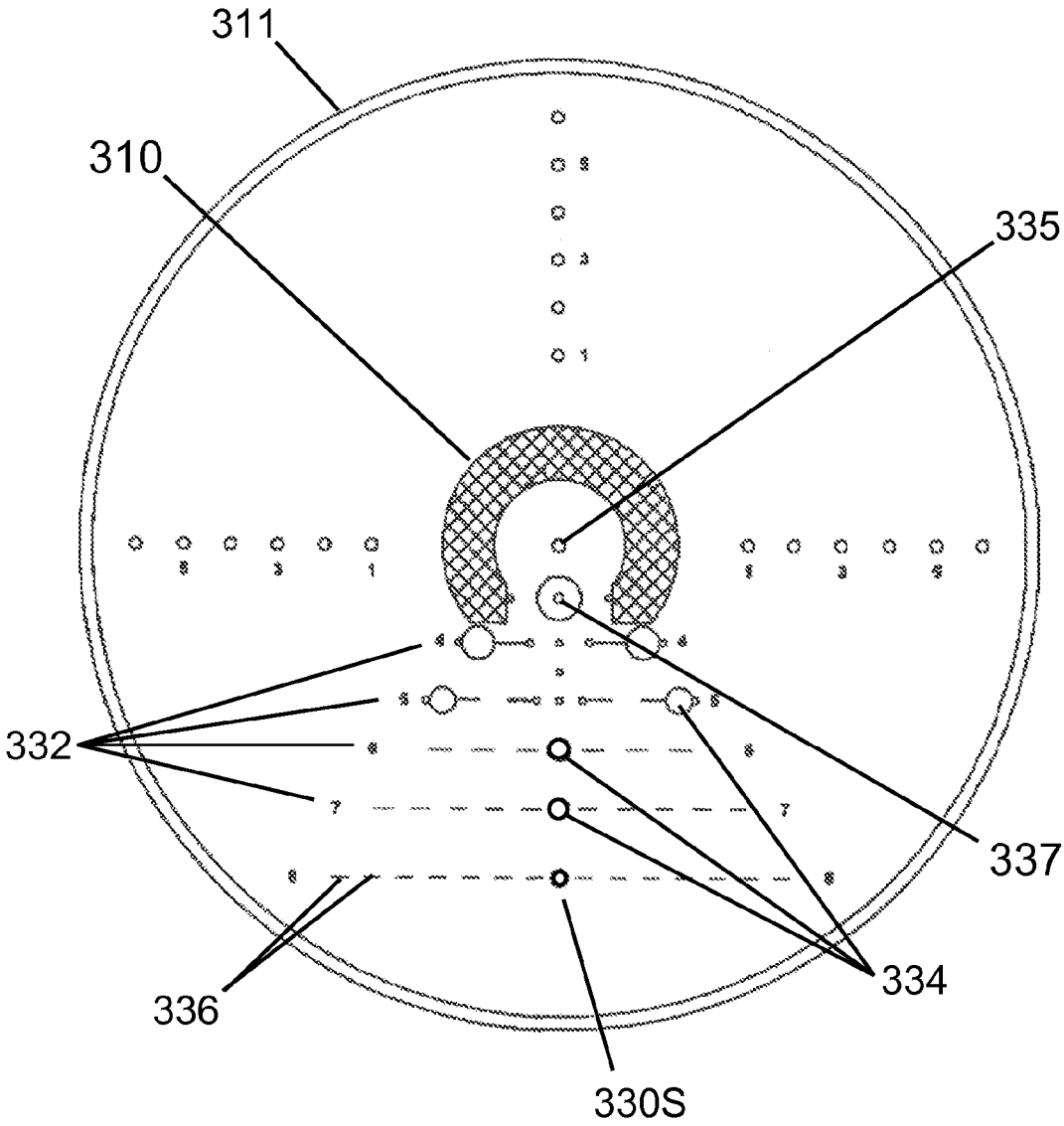
FIG. 3 is a plan view of an alternate embodiment of the reticule with caliber specific ranging.
Figure 4:
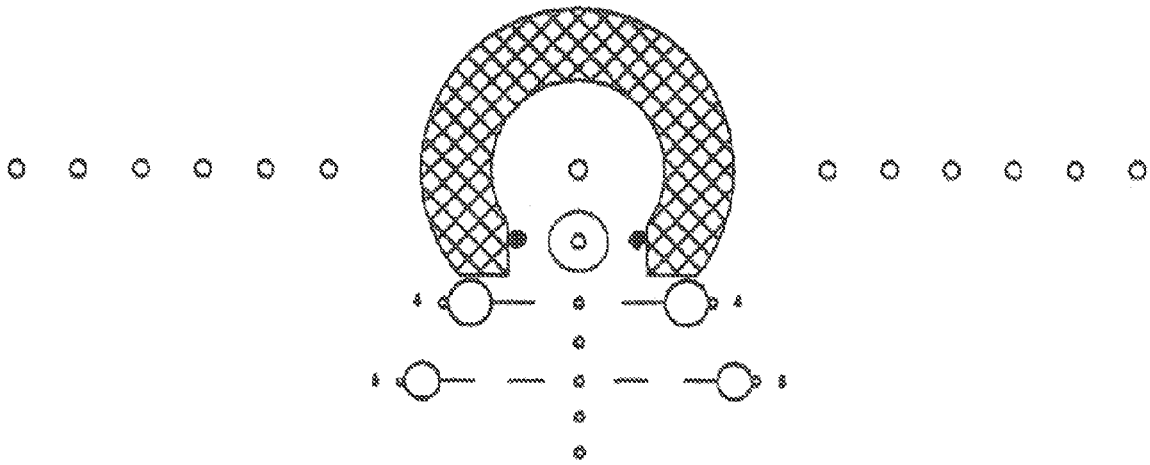
FIG. 4 is a plan view of a further alternate embodiment of the reticule with caliber specific ranging.

In FIG. 3, the reticule uses a caliber specific component for range shooting. In this embodiment, the CQB aspect of the reticule is maintained with aiming ring 310 while a customer may enjoy the convenience of a pre-set ranging system. The pre-set ranging system depicted is for an M4 rifle with a 14.5 inch barrel and a 62 grain bullet package (M855). The center dot 335 is set to correspond to the impact point at 100 yards. Since the drop between 100 and 200 yards for this package is only about 3 inches, a 200-yard impact point is not provided. Impact point 337 corresponds to 300 yards (and approximately a 12-inch relative drop from 100 yards). From this point, every successive range of 100 yards has an impact point set within a range indicator line 332 comprised of specially sized and spaced dashes 336. The dashes 336 and the spacing between them are equal length and correspond to 10-inch spacing at that corresponding distance. Ranging rings 334 are provided with all of the range indicator lines and with the 300-yard dot 337. Until the rings are small enough to not overlap, it is preferred they are set to the sides of the lines 336, as shown in the 400 and 500-yard range lines, though wherever possible, it is preferred they are in the center of the line, as shown with the 600 and successive range indicator lines. A highlighting ring 311 may be used to circumscribe the entire reticule, as shown in FIG. 3, or just the aiming ring 310. In the event a highlighting ring is used to circumscribe the aiming ring alone, the highlighting ring should also be incomplete on the bottom. Highlighting rings should be significantly thinner than the aiming ring and may actually be comprised of a number of thin rings. The reticule shown in FIG. 3 can be further simplified, as shown in FIG. 4, for shorter ranges and less clutter.

Although the present invention has been described with reference to preferred embodiments, numerous modifications and variations can be made, such as altering the shape of the dots or the cells, and still the result will come within the scope of the invention. No limitation with respect to the specific embodiments disclosed herein is intended or should be inferred.

What is claimed is:

1. A reticule comprising:

a. a central aiming ring of significant thickness, said ring defining a center and further comprising:
   i. a plurality of transparent cells and
   ii. a plurality of opaque cells; and b. an incomplete perimeter on a bottom side of the ring; and c. at least one set of guide dots, with at least one set of guide dots originating in the center of the aiming ring with a central aiming dot and said set of guide dots extending through the incomplete perimeter of the aiming ring into an area external of the aiming ring;

wherein, each set of guide dots is arranged as a series of dots, each pair of adjacent dots having an interstitial spacing, extending in a straight linear fashion and each dot represents a generic aiming point.

2. The reticule of claim 1, the ratio of transparent cells to opaque cells being greater than 1:1.

3. The reticule of claim 1, the set originating from the center of the aiming ring being comprised of at least two different sized dots, with larger dots being positioned near the center of the reticule.

4. The reticule of claim 3, wherein of the dots only the central aiming dot has any attached significance external the reticule.

5. The reticule of claim 1, further comprising at least one ranging system.

6. The reticule of claim 5, the ranging system being pre-set to a particular rifle and ammunition package.

7. The reticule of claim 6, the ranging system comprising:

a. A plurality of ranging indicators;

b. A plurality of distance indicators associated with the plurality of ranging indicators.

8. The reticule of claim 1, further comprising an illumination means.

9. The reticule of claim 1, wherein the central aiming ring is approximately four times thicker than the central aiming dot.

10. The reticule of claim 1, further comprising at least one reference line indicating an ordinal position of at least one dot in the set of dots originating from the center of the reticule.

11. The reticule of claim 1, the interstitial spacing between dots being smaller for pairs of dots furthest from the center dot than for a pair of dots including the central aiming dot.

12. The reticule of claim 1, wherein there is are four sets of guide dots, each defining a cardinal direction and the set extending in the southern direction is the set originating from the center.

13. The reticule of claim 11, the set originating from the center of the aiming ring being comprised of at least two different sized dots, with larger dots being positioned near the center of the reticule.

14. The reticule of claim 12, wherein of the dots only the central aiming dot has any attached significance external the reticule.

15. The reticule of claim 1, the cells' shape being selected from the set of shapes consisting of circles, ovals, quadrilaterals, pentagons, hexagons, heptagons, octagons, nonagons, and decagons.

16. The reticule of claim 1, further comprising at least one highlighting ring, circumscribing the remainder of reticule.

17. The reticule of claim 1, further comprising at least one highlighting ring, circumscribing the aiming ring and likewise having an incomplete bottom perimeter.

18. A reticule comprising:

a. a central aiming ring of significant thickness, said ring defining a center and further comprising a plurality of transparent cells b. an incomplete perimeter on a bottom side of the ring; and c. at least one set of guide dots, with at least one set of guide dots originating in the center of the aiming ring with a central aiming dot and said set of guide dots extending through the incomplete perimeter of the aiming ring into an area external of the aiming ring;

wherein, each set of guide dots is arranged as a series of dots, each pair of adjacent dots having an interstitial spacing determined by specific calculations of a bullet's drop over distance for a given caliber and charge, extending in a straight linear fashion.

19. The reticule of claim 18 further comprising a ranging system, said ranging system being further comprised of:

a. The set of guide dots;

b. Horizontal indication lines, extending about at least one dot in the set of guide dots; and c. Ranging indicators in line with the horizontal indication lines for a particular guide dot.

20. The reticule of claim 19, the cells' shape being selected from the set of shapes consisting of circles, ovals, quadrilaterals, pentagons, hexagons, heptagons, octagons, nonagons, and decagons.

* * * * *